US010132592B1

(12) United States Patent
Wei

(10) Patent No.: US 10,132,592 B1
(45) Date of Patent: Nov. 20, 2018

(54) BURST DEVICE OF TOY GUN

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 15/643,474

(22) Filed: Jul. 7, 2017

(51) Int. Cl.
*F41A 19/02* (2006.01)
*F41B 11/723* (2013.01)
*F41B 11/62* (2013.01)
*F41A 19/00* (2006.01)

(52) U.S. Cl.
CPC ..... *F41B 11/723* (2013.01); *F41A 19/00* (2013.01); *F41A 19/02* (2013.01); *F41B 11/62* (2013.01)

(58) Field of Classification Search
CPC ..... F41A 19/02; F41A 19/10; F41A 19/12; F41A 19/14; F41B 11/70
USPC ..... 124/31, 71, 72; 89/129.02
See application file for complete search history.

(56) References Cited

U.S. PATENT DOCUMENTS 2,948,194 A * 8/1960 Godar ..... F41A 19/02 89/129.02
4,004,496 A * 1/1977 Snodgrass ..... F41A 19/02 89/129.02
4,450,751 A * 5/1984 Thevis ..... F41A 17/46 89/129.02
4,594,934 A * 6/1986 Holstein ..... F41A 19/02 89/129.02
4,693,169 A * 9/1987 Beretta ..... F41A 19/02 89/129.02
4,941,394 A * 7/1990 Zedrosser ..... F41A 19/02 89/129.02
7,578,227 B1 * 8/2009 Jacob ..... F41A 19/02 89/139
7,878,106 B2 * 2/2011 Hu ..... F41A 19/02 89/129.02
8,051,848 B2 * 11/2011 Maeda ..... F41B 11/62 124/75
8,360,042 B2 * 1/2013 Skilling ..... F41A 1/06 124/71
9,267,751 B2 * 2/2016 Ruiz ..... F41A 19/12
9,410,759 B2 * 8/2016 Smith, Jr. ..... F41A 19/10
9,587,903 B2 * 3/2017 Sullivan ..... F41A 9/71
9,651,329 B2 * 5/2017 Hittmann ..... F41A 19/10
9,658,017 B2 * 5/2017 Alicea ..... F41A 19/59
2017/0102199 A1 * 4/2017 Alicea, Jr. ..... F41A 17/20

* cited by examiner

*Primary Examiner* — Alexander Niconovich
(74) *Attorney, Agent, or Firm* — Chun-Ming Shih; HDLS IPR Services

(57) ABSTRACT

A burst device of a toy gun (8) with a mechanical box (800) includes a sliding mechanism (10), a pressing mechanism (20) and a stop part (30). The sliding mechanism (10) includes a sliding part (11), a rod (12) and an elastic member (13) and has linear teeth (111); the pressing mechanism (20) is installed to the sliding mechanism (10) and includes a pressing plate (21) and a pressing part (22), and the pressing part (22) has a latch block (221) for sliding the sliding part (11) with respect to the rod (12); the stop part (30) is pivotally coupled to the mechanical box (800) and configured to be corresponsive to the sliding part (11) and has a stopper (31) for stopping any tooth (111) after the latch block (221) stops pushing the tooth (111), so as to achieve high reliability and stability of a burst action.

9 Claims, 19 Drawing Sheets

BURST DEVICE OF TOY GUN

FIELD OF THE INVENTION

This disclosure relates to the technology of toy guns, and more particularly to a burst device of a toy gun.

BACKGROUND OF THE INVENTION

With the diversified development of life, some people choose to release their accumulated stress by leisure activities and pursue a fresh and exciting leisure activity, so that toy guns such as BB guns, paintball guns, and air guns apparently become one of the popular contemporary leisure activities. To improve the fun, most toy guns come with a single or burst shooting option, but the burst mechanism of the conventional burst toy guns includes complicated components and has the issues of bad coordination and inefficient action between components, and thus resulting in a poor effect such as producing a non-continuous burst action or an incomplete operation or increasing the cost due to a complicated structure.

In view of the aforementioned drawbacks of the prior art, the discloser of this disclosure conducted extensive research and provided a feasible design to overcome the drawbacks of the prior art.

SUMMARY OF THE INVENTION

Therefore, it is a primary objective of the present invention to provide a burst device of a toy gun that uses a sliding part, a pressing part and a stop part to achieve high reliability and stability of a burst action.

To achieve the aforementioned and other objectives, this disclosure provides a burst device of a toy gun with a mechanical box and the burst device comprises a sliding mechanism, a pressing mechanism and a stop part, wherein the sliding mechanism includes a sliding part, a rod passed and coupled to the sliding part, and an elastic member sheathed on the rod and elastically abutting the sliding part, and the sliding part has a plurality of teeth; the pressing mechanism is disposed on a side of the sliding mechanism and includes a pressing plate and a pressing part pivotally coupled to the pressing plate, and the pressing part has a latch block operably pushed with respect to each of the teeth to slide the sliding part with respect to the rod; and the stop part is pivotally coupled to the mechanical box which is configured to be corresponsive to the sliding part and has a stopper for stopping any one of the teeth after the latch block stops pushing the tooth.

This disclosure has the following effects. Each tooth is linearly arranged, so that when the teeth are operated with respect to the latch block and the stopper, a precise positioning and latching effect can be achieved. The assembly of the burst device of this disclosure includes simple components, and thus the component and material costs can be reduced effectively.

DESCRIPTION OF THE PREFERRED EMBODIMENTS

The technical contents of this disclosure will become apparent with the detailed description of preferred embodiments accompanied with the illustration of related drawings as follows. It is noteworthy that the preferred embodiments are provided for illustrating this disclosure rather than restricting the scope of the disclosure.

Figure 1:
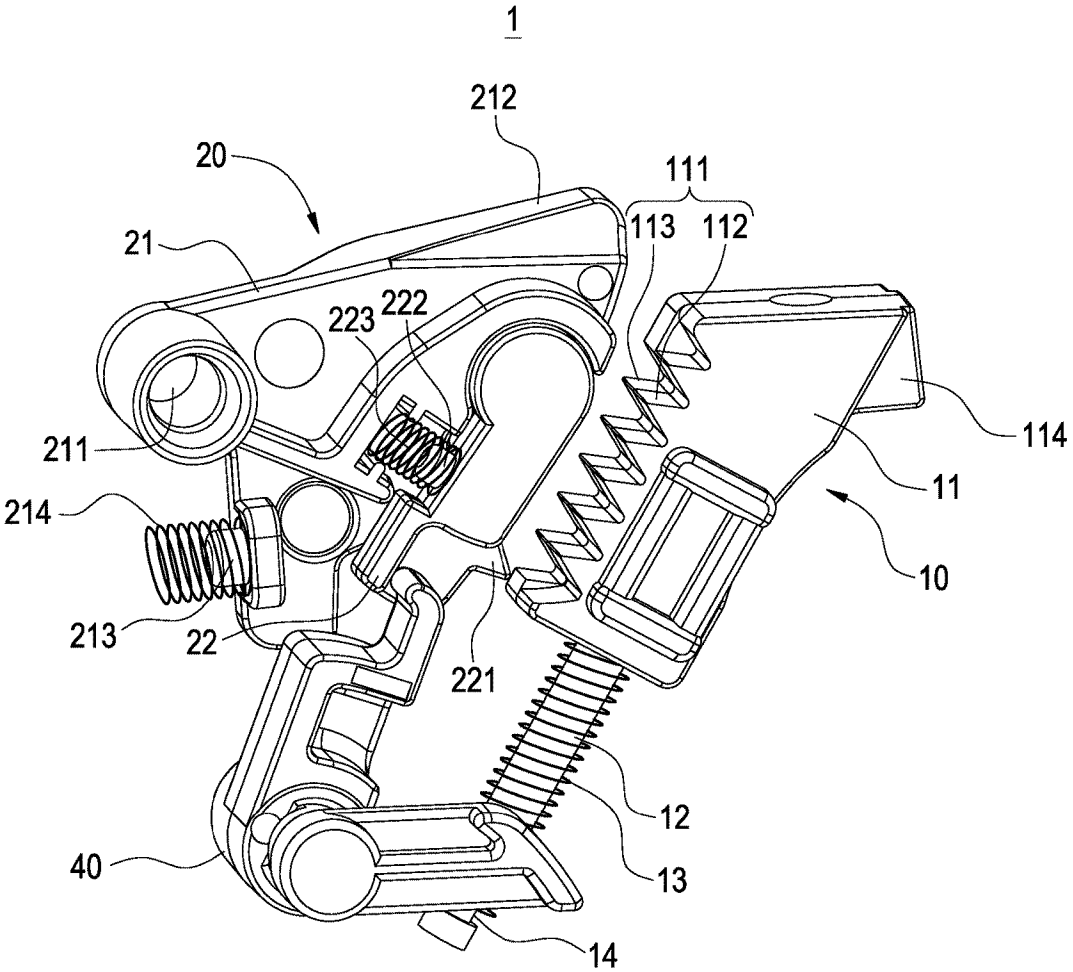
FIG. 1 is a configuration diagram of a sliding mechanism, a pressing mechanism and a lever of this disclosure.
Figure 2:
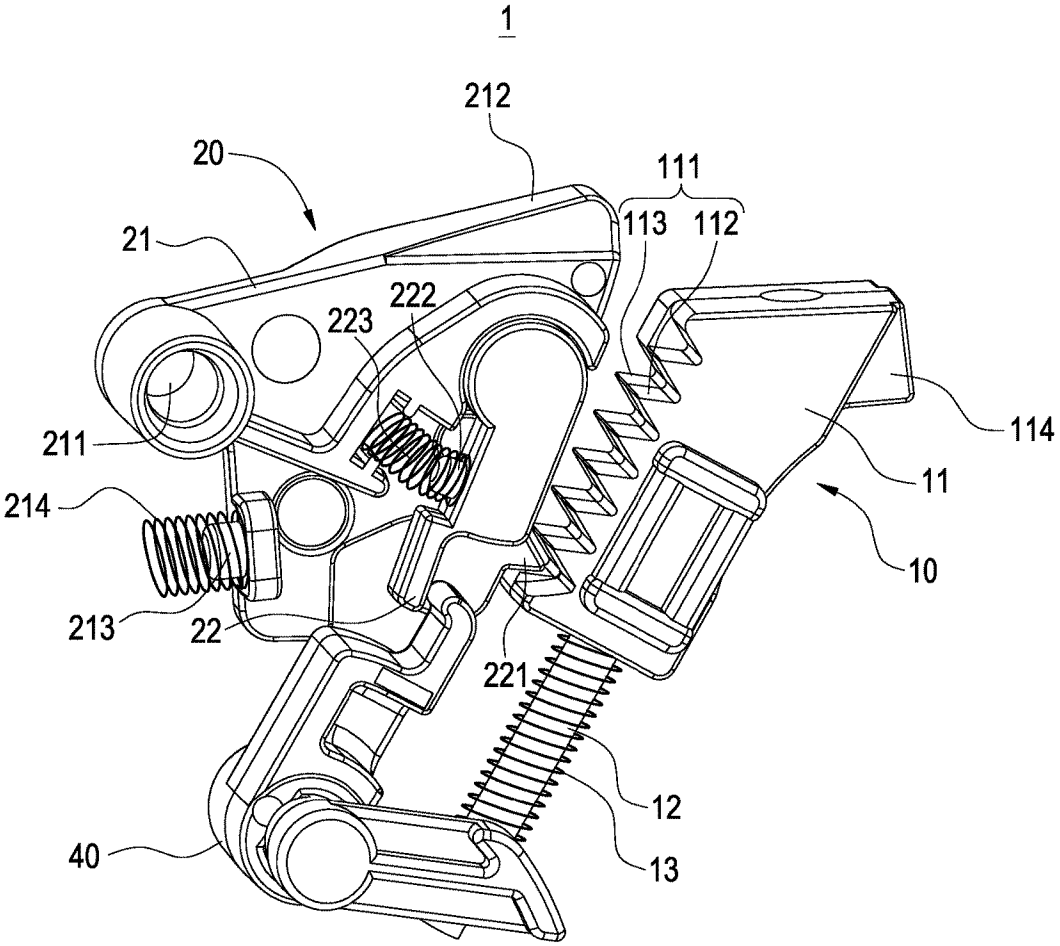
FIG. 2 is a schematic view of a pressing part pressing at a tooth of a sliding part in accordance with this disclosure.
Figure 3:
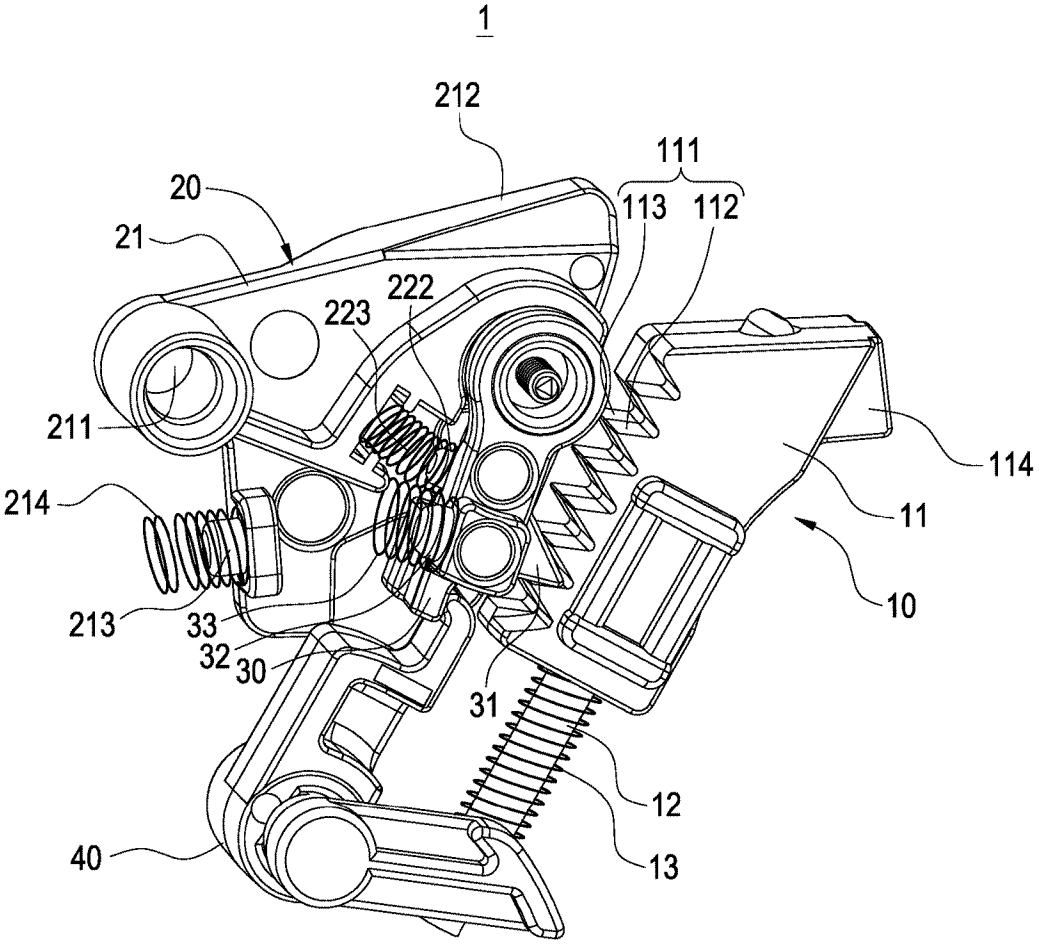
FIG. 3 is a schematic view of a stop part embedded with teeth in accordance with this disclosure.
Figure 4:
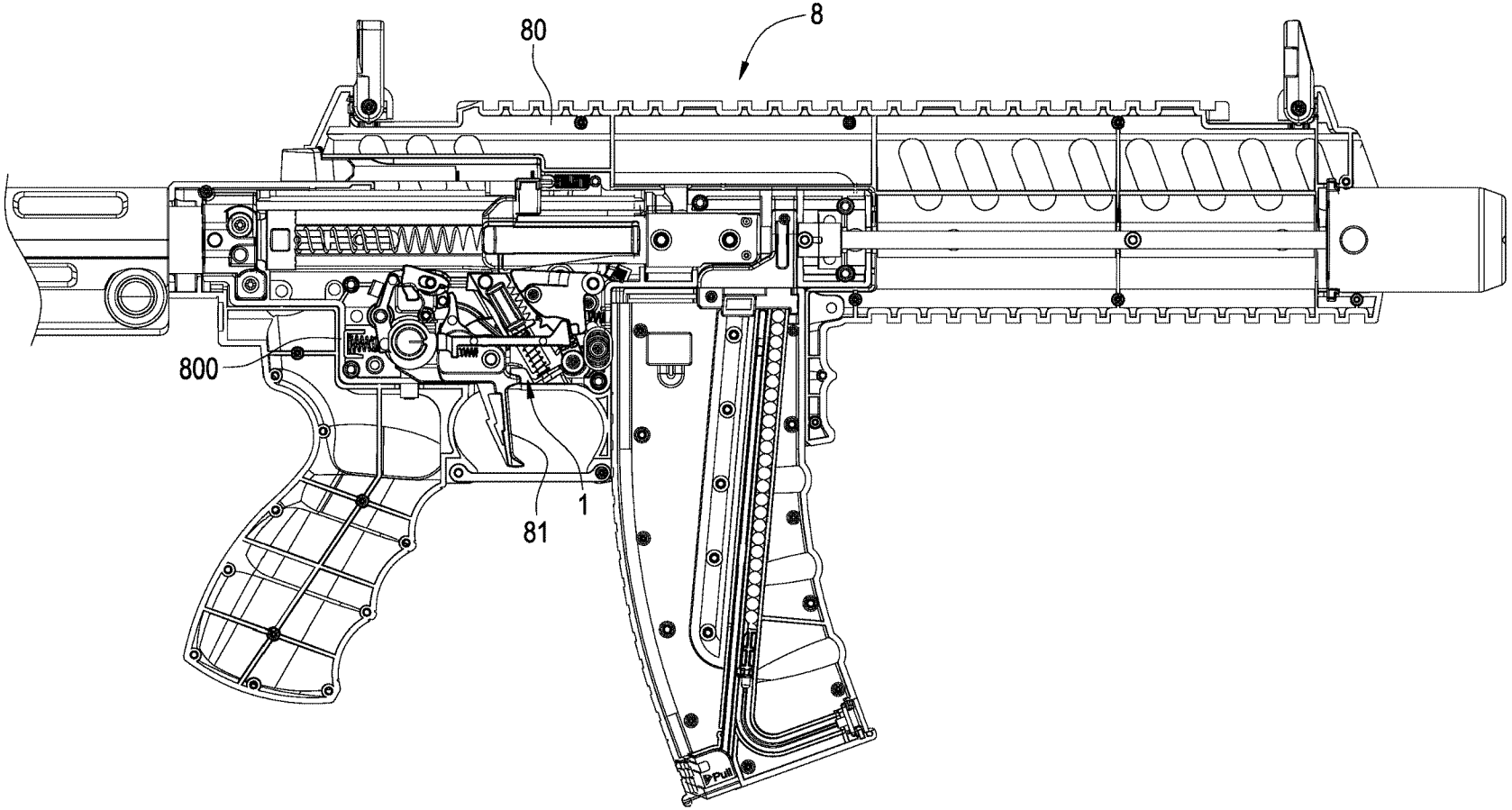
FIG. 4 is a schematic view of an assembly applied to a toy gun in accordance with this disclosure.
Figure 5:
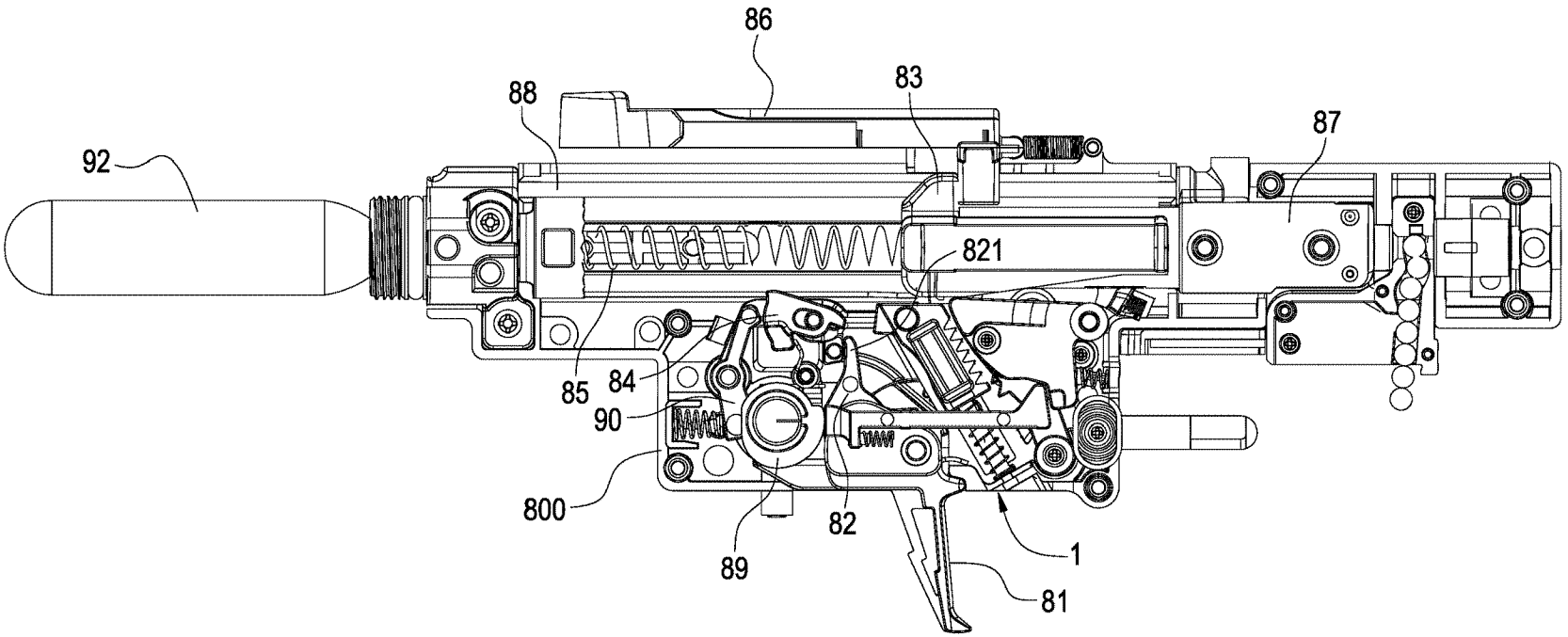
FIG. 5 is a partial blowup view of FIG. 4.

With reference to FIGS. 1 to 3 for a burst device of a toy gun in accordance with this disclosure, the burst device is applied to the toy gun 8, and the toy gun 8 has a gun body 80, a mechanical box 800 and a trigger 81 disposed at the middle area of the gun body 80, and the burst device 1 is installed in the mechanical box 800 (as shown in FIGS. 4 and 5) and comprises a sliding mechanism 10, a pressing mechanism 20 and a stop part 30.

The sliding mechanism 10 includes a sliding part 11, a rod 12 and an elastic member 13, and a side of the sliding part 11 has a plurality of linearly arranged teeth 111, and each tooth 111 of this preferred embodiment includes an inner tooth 112 and an outer tooth 113 parallel to the inner tooth 112, and a bump 114 is extended outwardly from the top of the sliding part 11 on the opposite side of the tooth 111. The rod 12 is passed and coupled to the middle position of the sliding part 11, and the elastic member 13 of this preferred embodiment is a compression helical spring, and an end of the rod 12 away from the sliding part 11 has an insert slot 14 for embedding and fixing the mechanical box 800, and both ends of the elastic member 13 are elastically clamped between end surfaces of the mechanical box 800 and the sliding part 11.

The pressing mechanism 20 is disposed on a side of the sliding mechanism 10 and includes a pressing plate 21 and a pressing part 22, and the pressing plate 21 is substantially a fan shaped body, having a shaft hole 211 formed at the center of the pressing plate 21, a pressure bearing portion 212 disposed on a side away from the shaft hole 211, a first column 213 formed on the pressing plate 21 under the shaft hole 211 and provided for sheathing and coupling a first spring 214 which is elastically clamped between the pressing plate 21 and the mechanical box 800. The pressing part 22 is pivotally coupled to the pressing plate 21, and a latch block 221 is disposed on a side of the pressing part 22, and a second column 222 is disposed on the pressing part 22 on the opposite side of the latch block 221 and provided for sheathing and coupling a second spring 223 which is elastically clamped between the pressing part 22 and the pressing plate 21. Wherein, the latch block 221 is configured to be corresponsive to the respective outer tooth 113 and operably and downwardly pushed with respect to the respective outer tooth 113 in order to slide the sliding part 11 downwardly with respect to the rod 12.

The stop part 30 is pivotally coupled to the mechanical box 800 and configured to be corresponsive to the sliding part 11, and the stop part 30 is disposed on a side of the pressing part 22, and a stopper 31 is disposed on a side of the stop part 30, and a third column 32 is disposed on the stop part 30 on the opposite side of the stopper 31 and provided for sheathing and coupling a third spring 3. Wherein, the stopper 31 is configured to be corresponsive to the respective inner tooth 112, and the stopper 31 can stop any inner tooth 112 after the latch block 221 stops pushing the respective outer tooth 113.

Figure 6A:
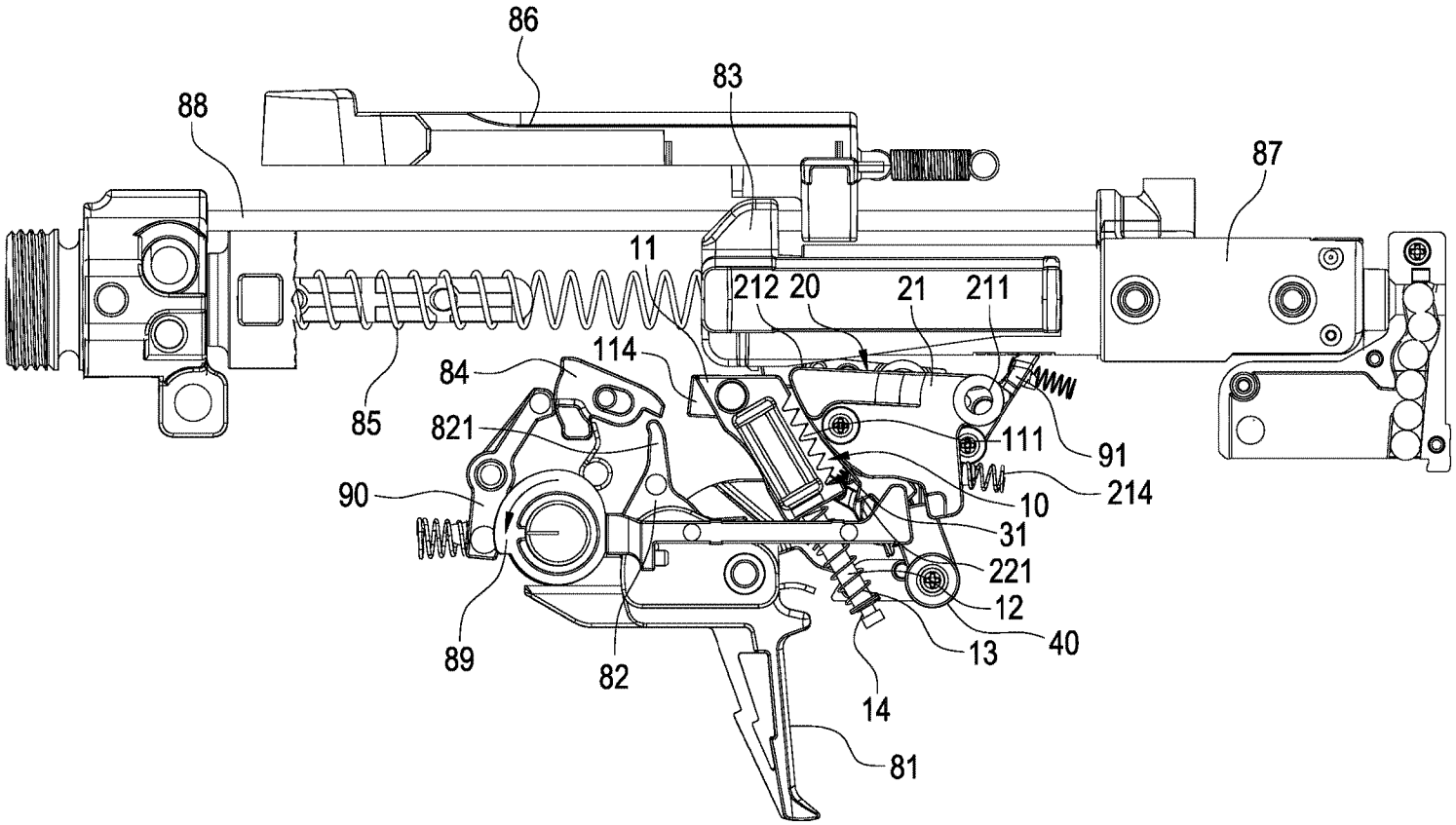
FIG. 6A is a first schematic view of a using status of this disclosure.
Figure 6B:
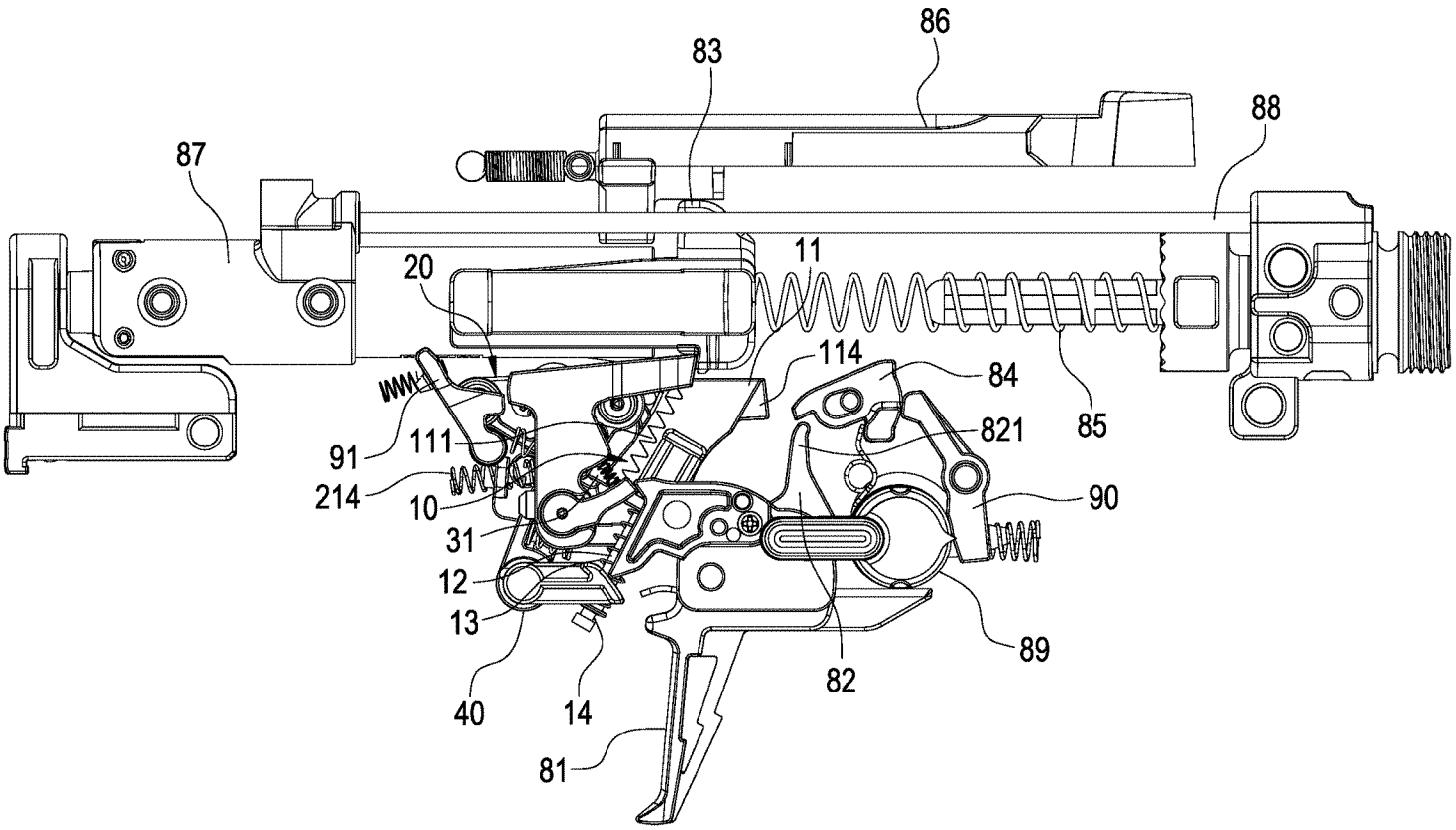
FIG. 6B is a back view of FIG. 6A.

Further, the burst device of a toy gun of this disclosure further comprises a lever 40 installed at a position under the sliding mechanism 10 and the pressing mechanism 20, and the lever 40 is substantially a V-shaped, and an open-end arm is configured to be corresponsive to the pressing part 22 and the stop part 30, and the other arm abuts the trigger 81 (as shown in FIG. 6B).

Figure 8A:
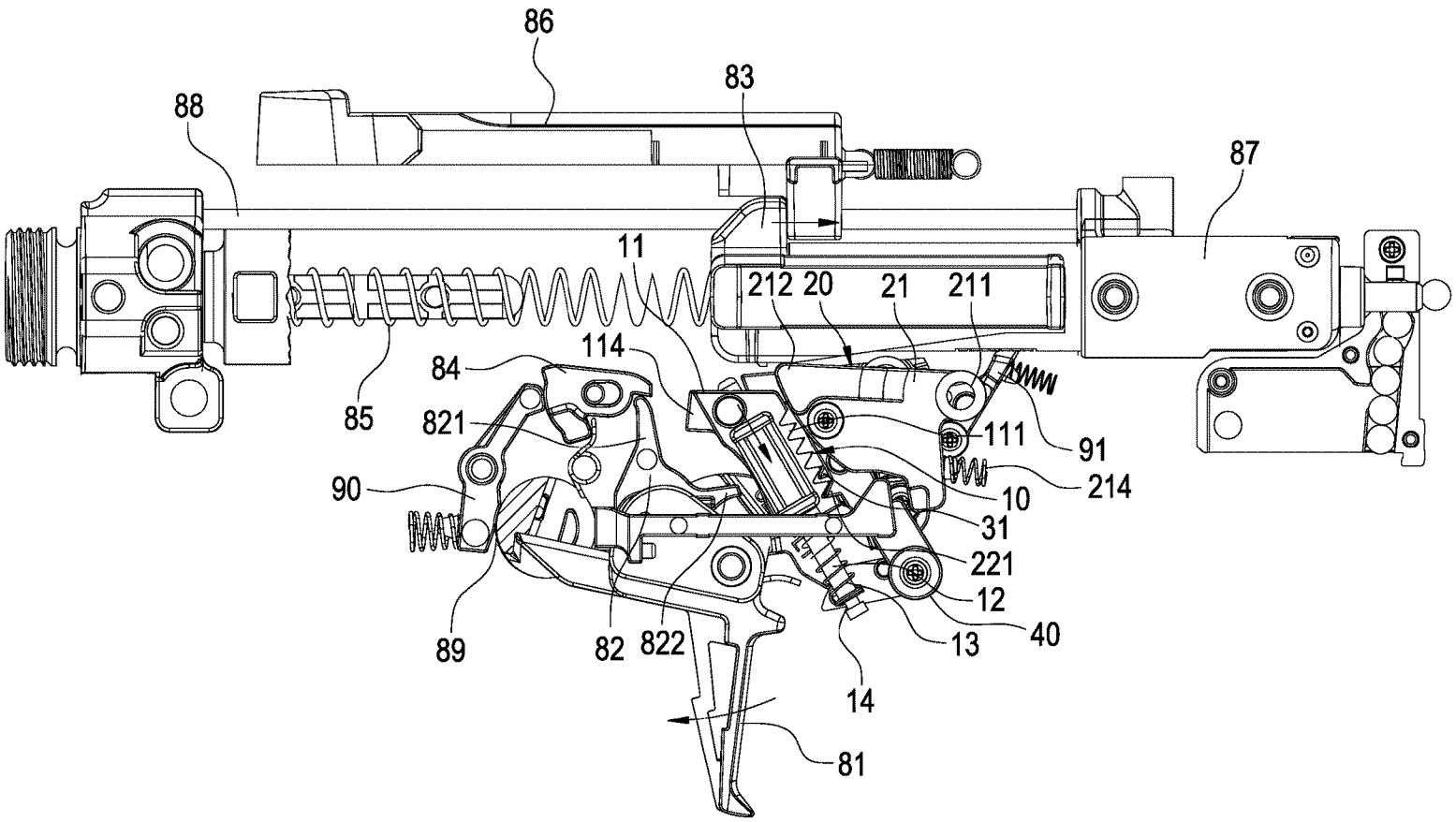
FIG. 8A is a third schematic view of a using status of this disclosure.

In FIGS. 4 and 5, the toy gun 8 further comprises a trigger link rod 82, a hammer 83, a hammer latch 84, a hammer spring 85, a cocking handle 86, an air chamber component 87, a gas transmission pipe 88, a switch button 89, a switch link rod 90, a safety latch rod 91, a cylinder 92 and related mechanisms or devices, wherein the trigger link rod 82 has a first arm 821 and a second arm 822 (as shown in FIG. 8A), and the cylinder 92 is communicated with the air chamber component 87 through the gun body 80 and the gas transmission pipe 88.

In FIGS. 6A and 6B, when the switch button 89 is rotated to a burst position, a cam (not labeled in the figure) of the switch button 89 will abut the bottom end of the switch link rod 90, so that the top end of the switch link rod 90 is attached to an end of the hammer latch 84. Now, the hammer latch 84 can be moved in an arc shape with respect to its axis.

Figure 7A:
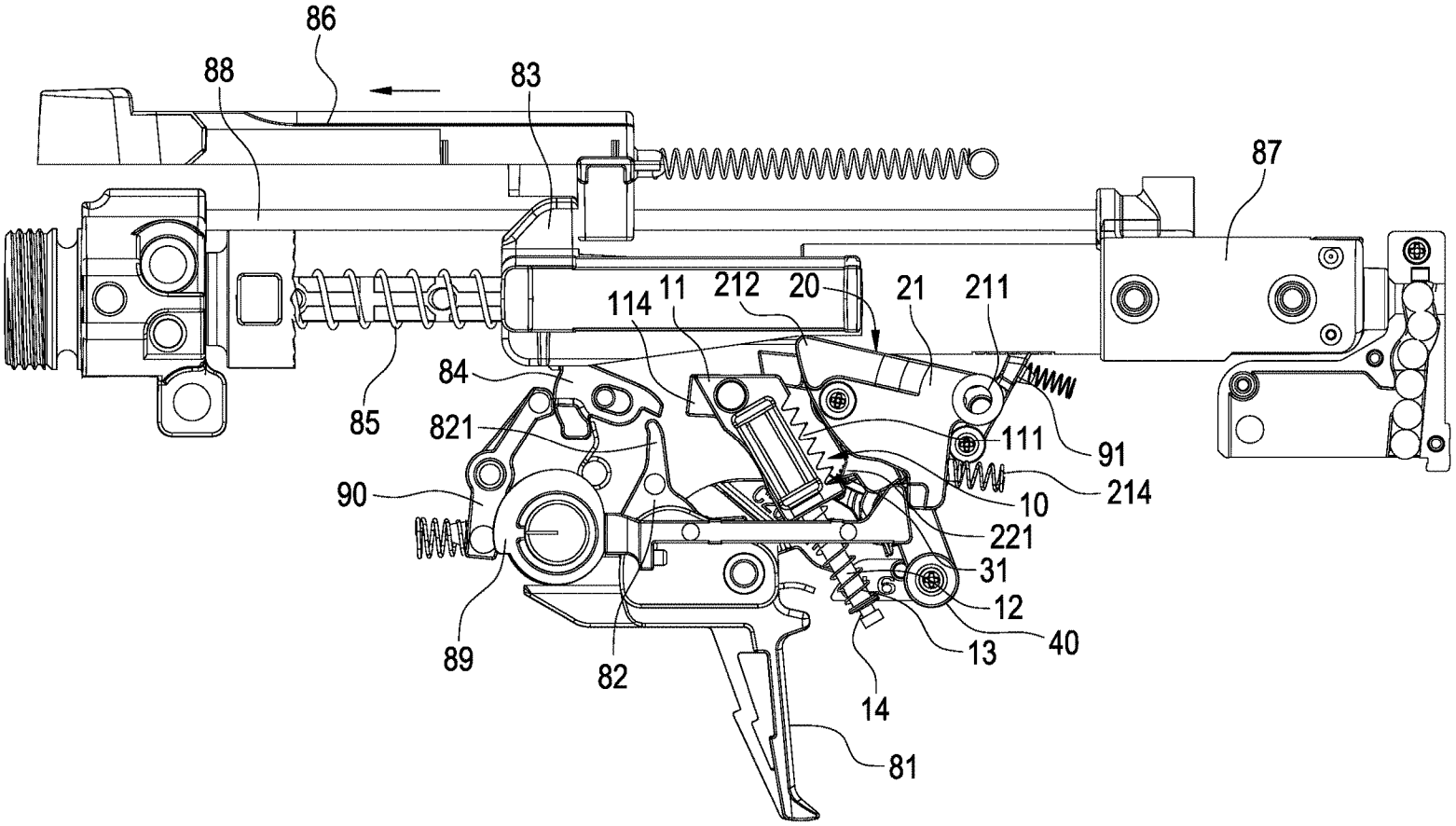
FIG. 7A is a second schematic view of a using status of this disclosure.
Figure 7B:
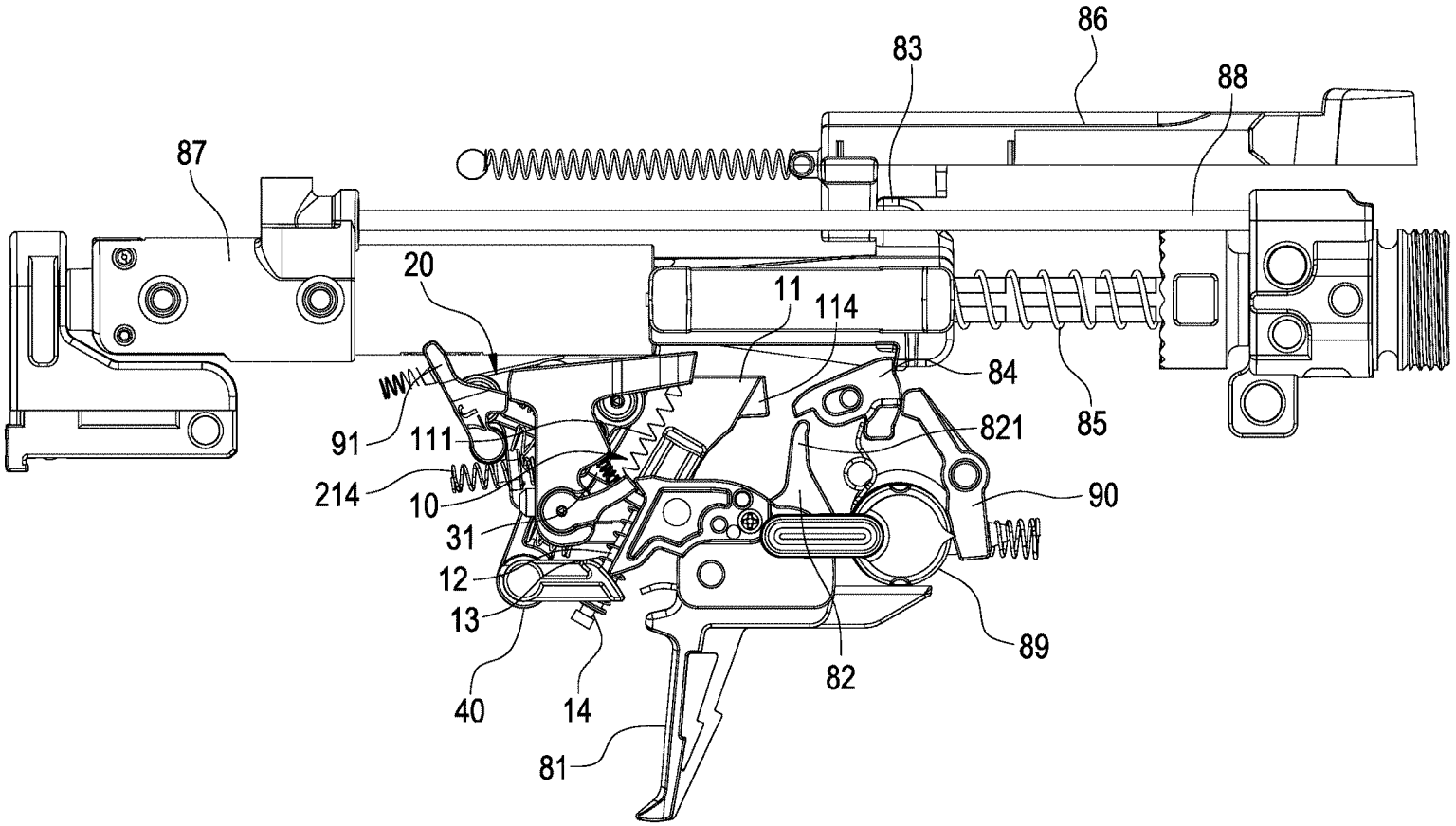
FIG. 7B is a back view of FIG. 7A.

In FIGS. 7A and 7B, the cocking handle 86 is pulled to slide towards the rear of the gun body 80. Now, the bottom end of the hammer 83 is latched to the hammer latch 84 for positioning (as shown in FIG. 7B), and the hammer 83 is provided for pressing and pushing the hammer spring 85 towards the front of the gun body 80, so that the hammer latch 84 can be rotated clockwise with respect to its axis, and the hammer latch 84 and an first arm 821 of the trigger link rod 82 are engaged with each other (as shown in FIG. 7A).

Figure 8B:
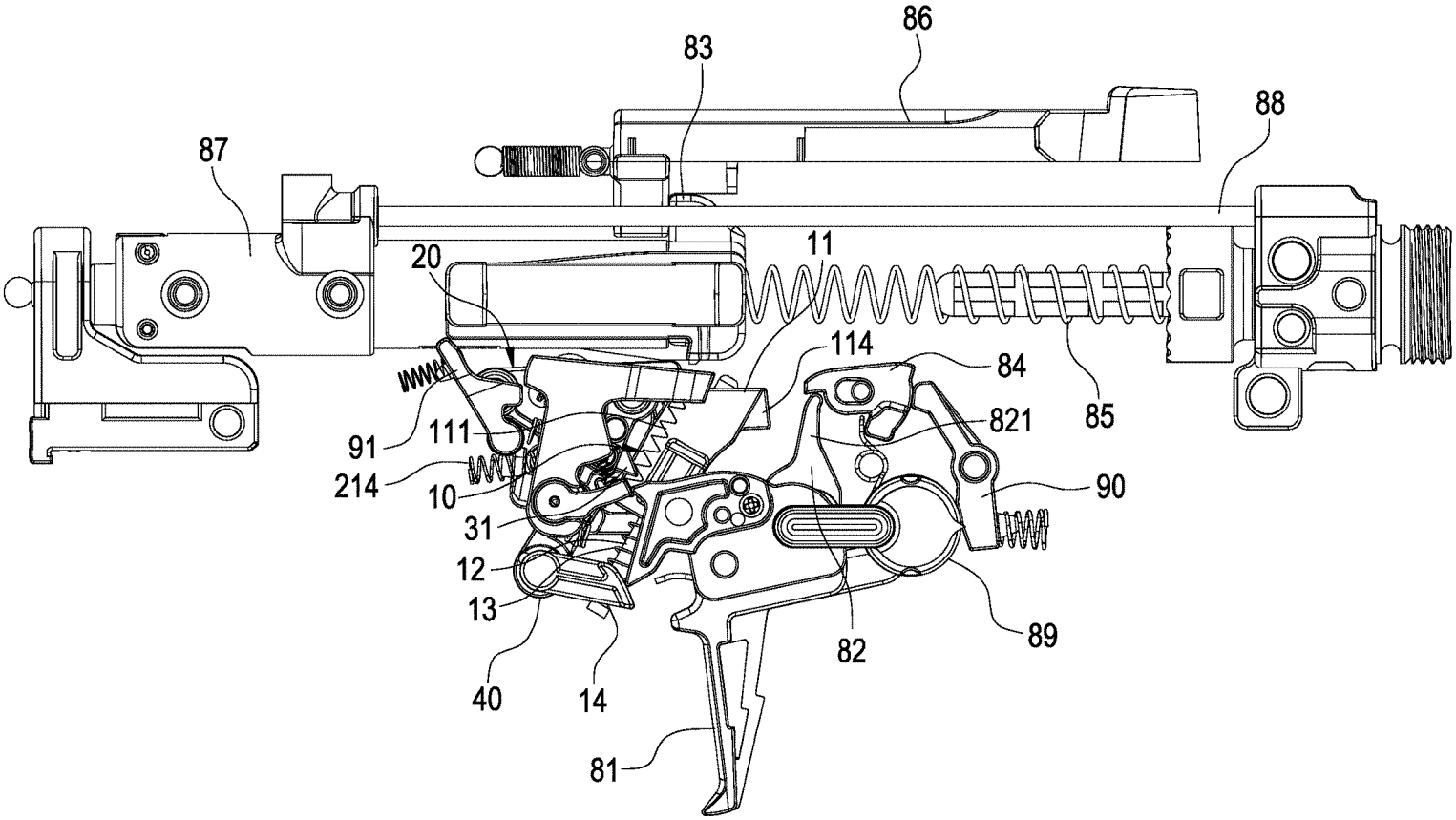
FIG. 8B is a back view of FIG. 8A.

In FIGS. 8A and 8B, the trigger 81 is linked to the lever after being pulled, so that the pressing part 22 latches with the lowest outer tooth 113 while the first arm 821 of the trigger link rod 82 is turning the hammer latch 84 to perform a counterclockwise arc rotation by using its axis as center. After the hammer 83 is released from the limitation of the hammer latch 84, the elastic force of the hammer spring 85 drives the hammer 83 to slide towards the air chamber component 87. After the hammer 83 enters into the air chamber component 87, the safety latch rod 91 is pushed away. Now, a portion of air coming from the gas transmission pipe 88 drives a bullet to shoot out from a barrel (not labeled in the figure).

Figure 9A:
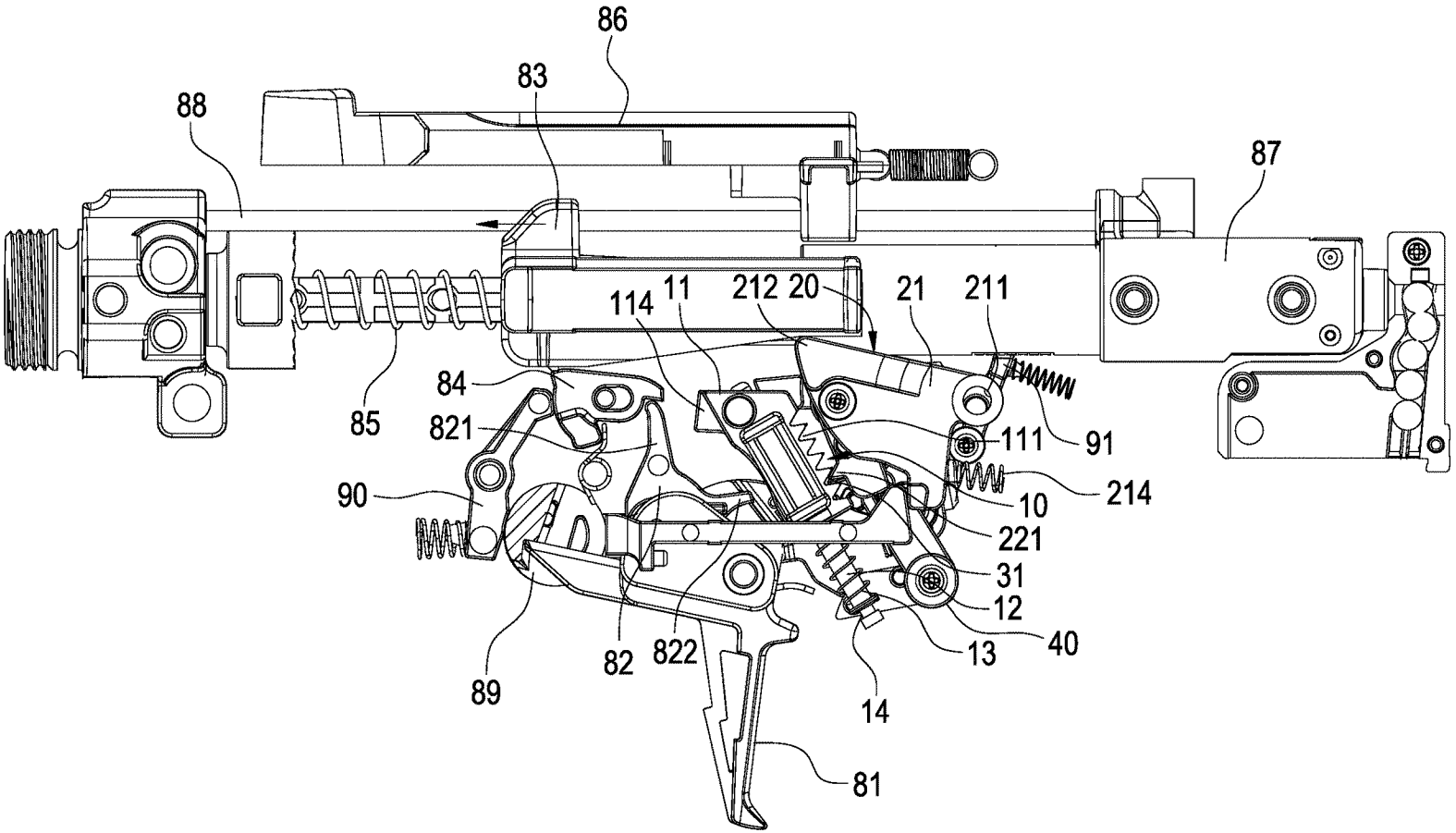
FIG. 9A is a fourth schematic view of a using status of this disclosure.
Figure 9B:
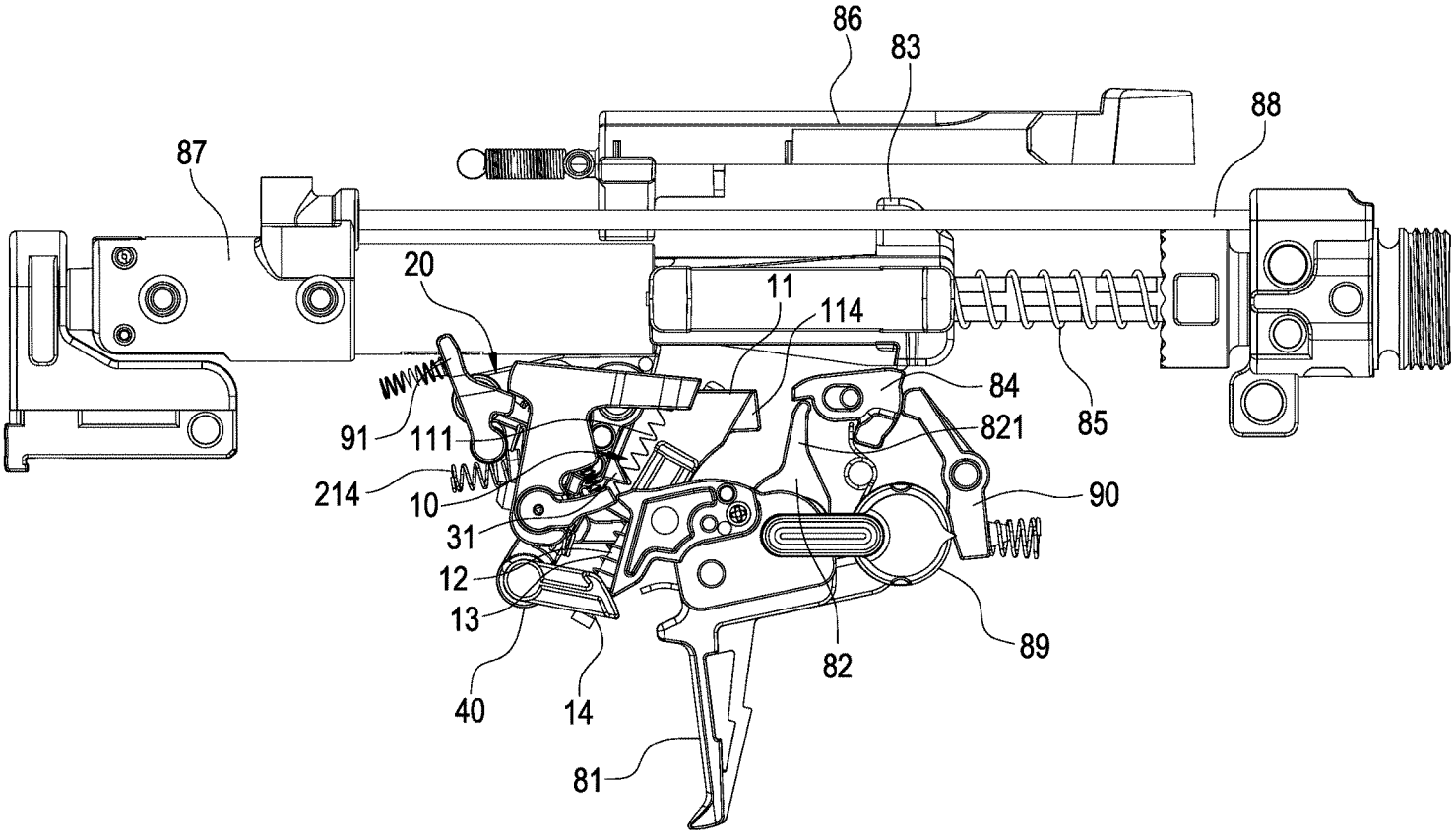
FIG. 9B is a back view of FIG. 9A.

In FIGS. 9A and 9B, the other portion of air is used for pushing the hammer 83 towards the hammer latch 84. Now, the hammer latch 84 is propped by the trigger link rod 82, so that the hammer 83 is driven by the hammer spring 85 to move towards the front of the gun body 80 and continue to strike at the air chamber component 87, so as to achieve a continuous firing effect.

Figure 10A:
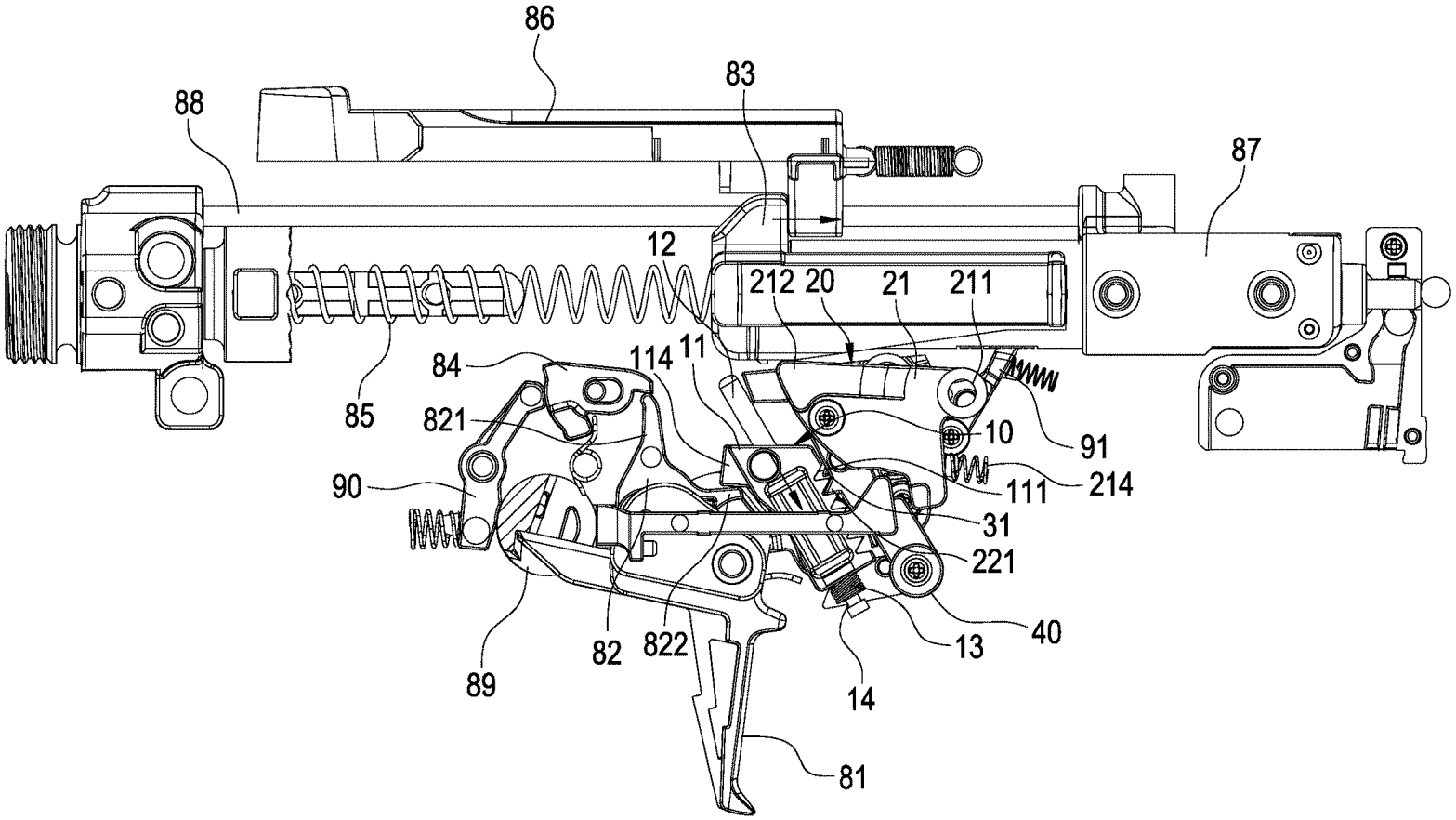
FIG. 10A is a fifth schematic view of a using status of this disclosure.
Figure 10B:
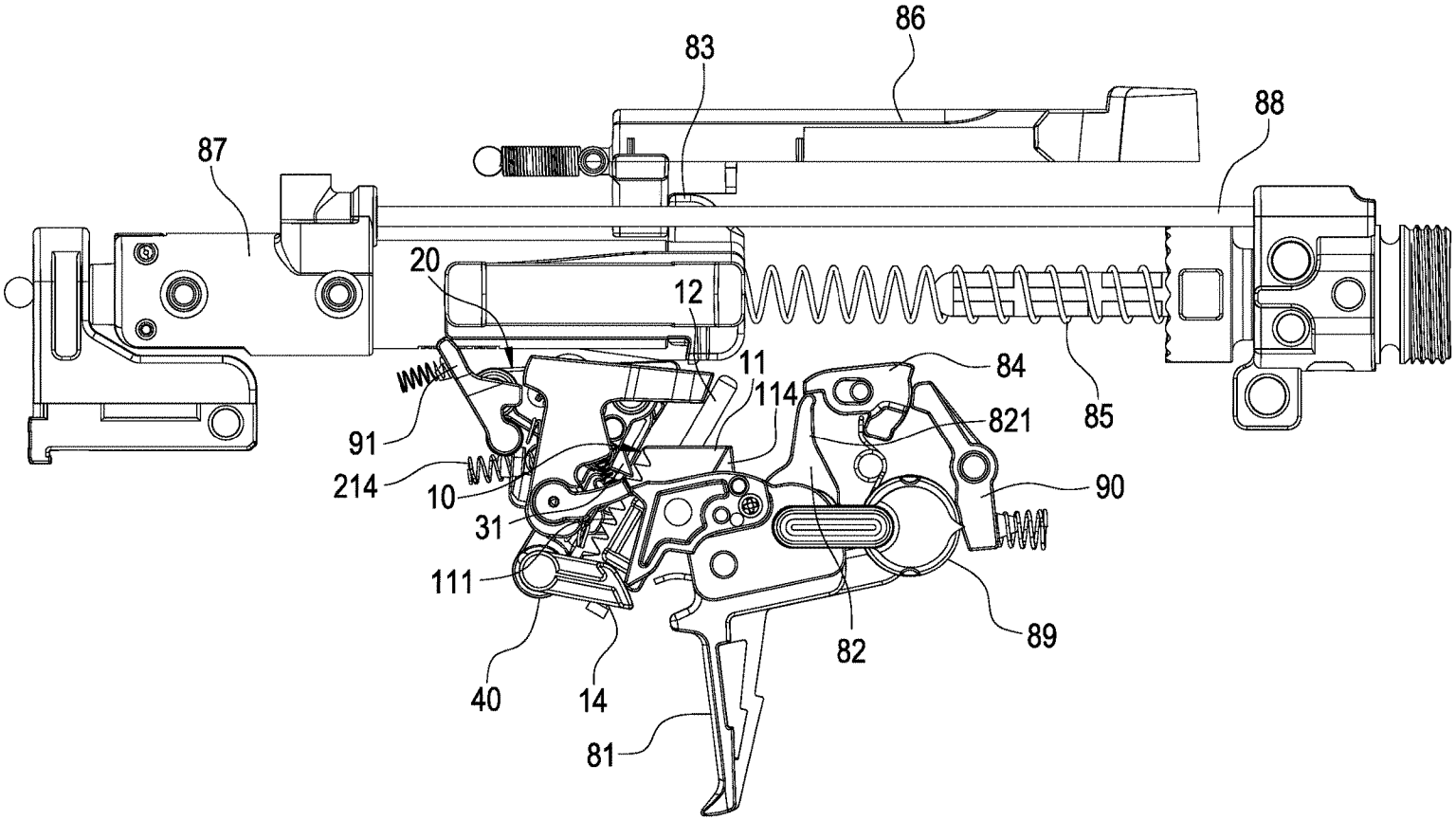
FIG. 10B is a back view of FIG. 10A.

In FIGS. 10A and 10B, if the hammer 83 moves towards the air chamber component 87, the moving of the hammer 83 will press the pressure bearing portion 212 of the pressing plate 21 and link the pressing part 22, and the latch block 221 of the pressing part 22 will press the outer tooth 113 and drive the sliding part 11 to slide towards the bottom of the rod 12, and then the stop part 30 is elastically driven by the third spring 33 to stop the lowest inner tooth 112 by the stopper 31. With the interaction of the hammer spring 85 and gas pressure, the hammer 83 is moved back and forth continuously. With the continuous movements of the hammer 83 with the pressing plate 21, and the pressing plate 21 with the pressing part 22 and the stop part 30, the latch block 221 of the pressing part 22 can be moved back and forth with the pressing plate 21 to press the outer teeth 113 intermittently and sequentially and drive the sliding part 11 to slide towards the bottom of the rod 12 continuously. After the latch block 221 completes pressing the outer teeth 113, the stopper 31 of the stop part 30 stops the inner teeth 112 sequentially to achieve a continuous firing effect.

Figure 11A:
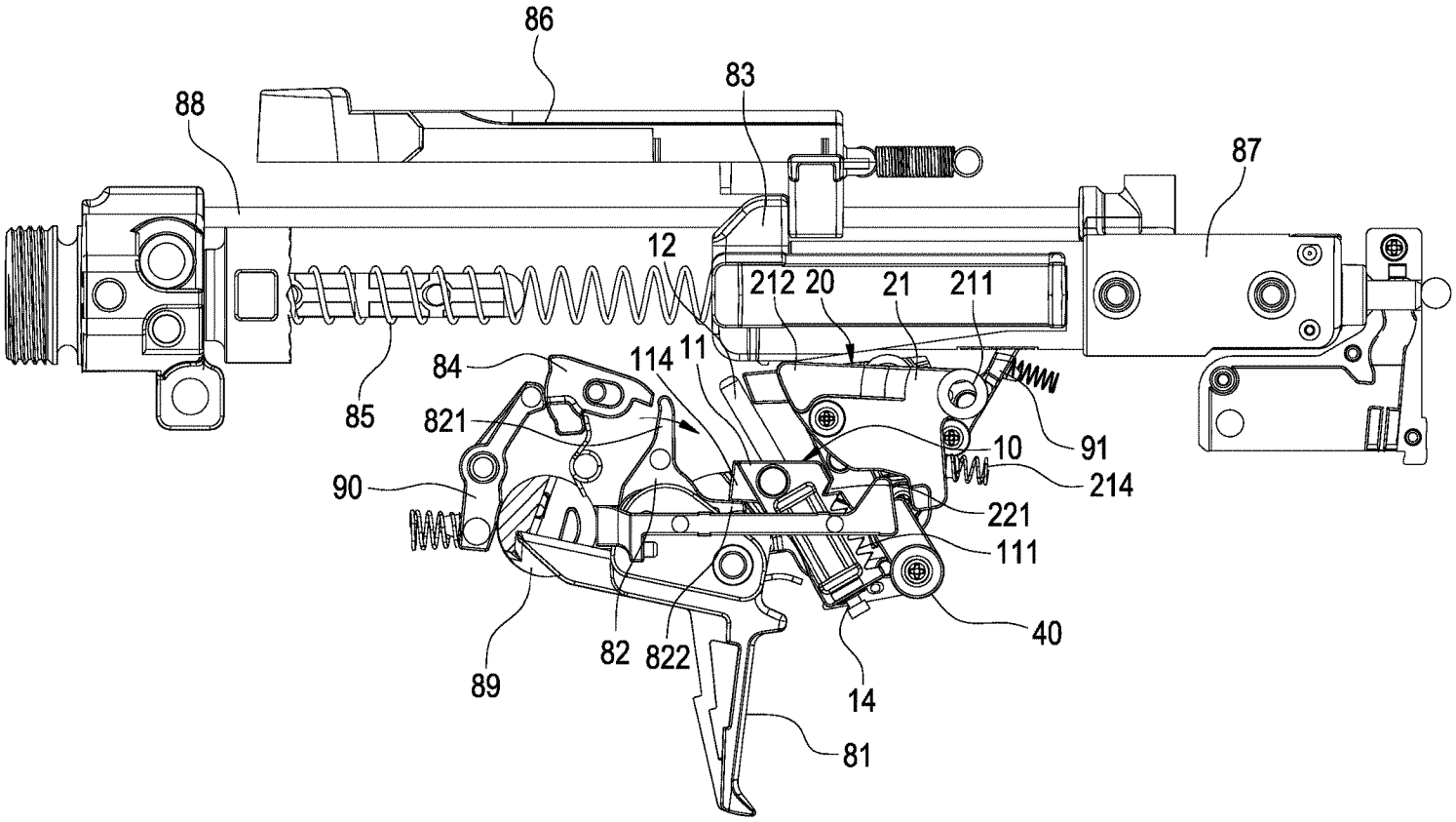
FIG. 11A is a sixth schematic view of a using status of this disclosure.
Figure 11B:
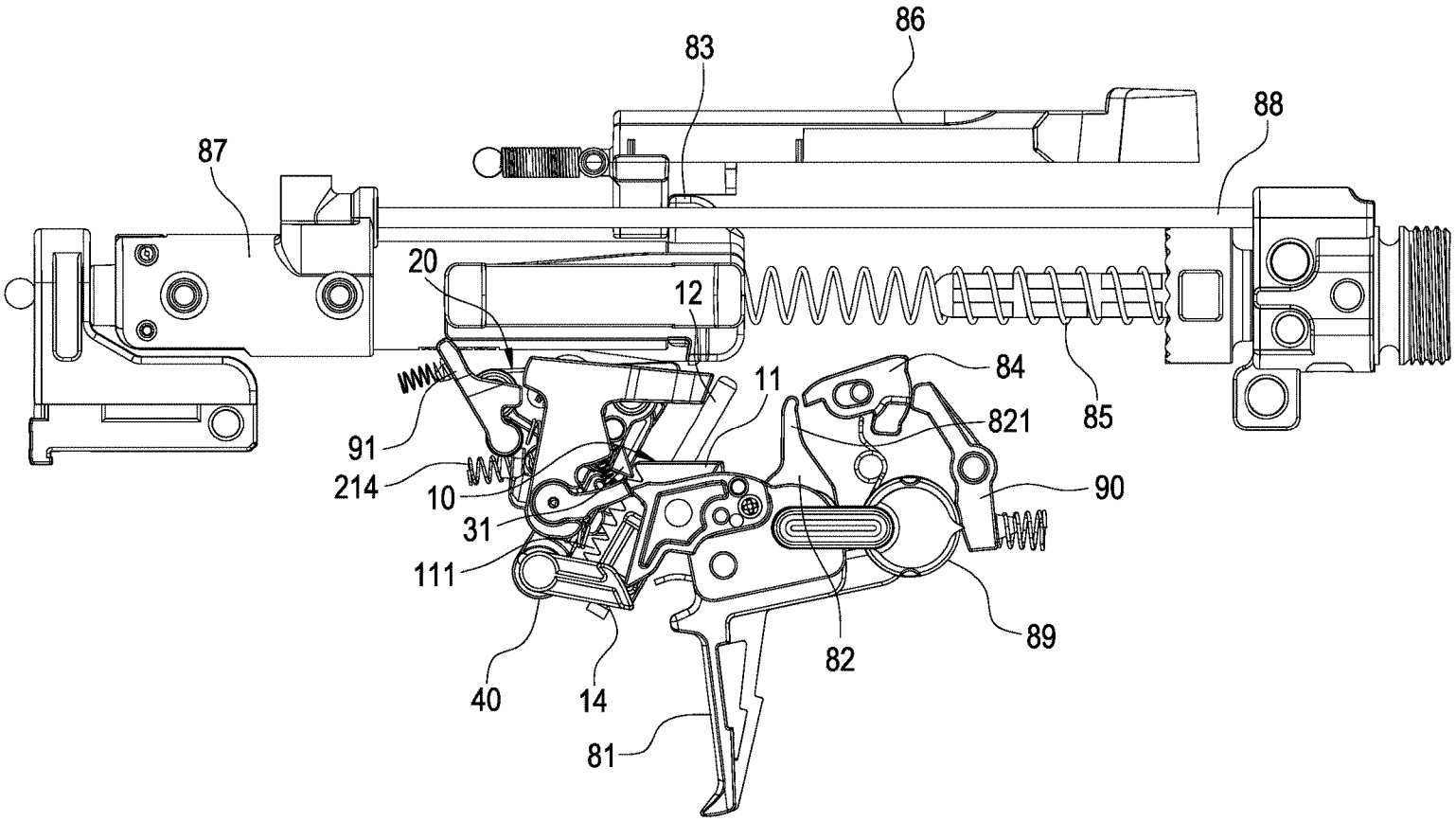
FIG. 11B is a back view of FIG. 11A.

In FIGS. 11A and 11B, after the latch block 221 completes pressing the last one of the outer teeth 113, the bump 114 of the sliding part 11 will press the second arm 822 of the trigger link rod 82, so that the hammer latch 84 can be released from the latch with the first arm 821 of the trigger link rod 82.

Figure 12A:
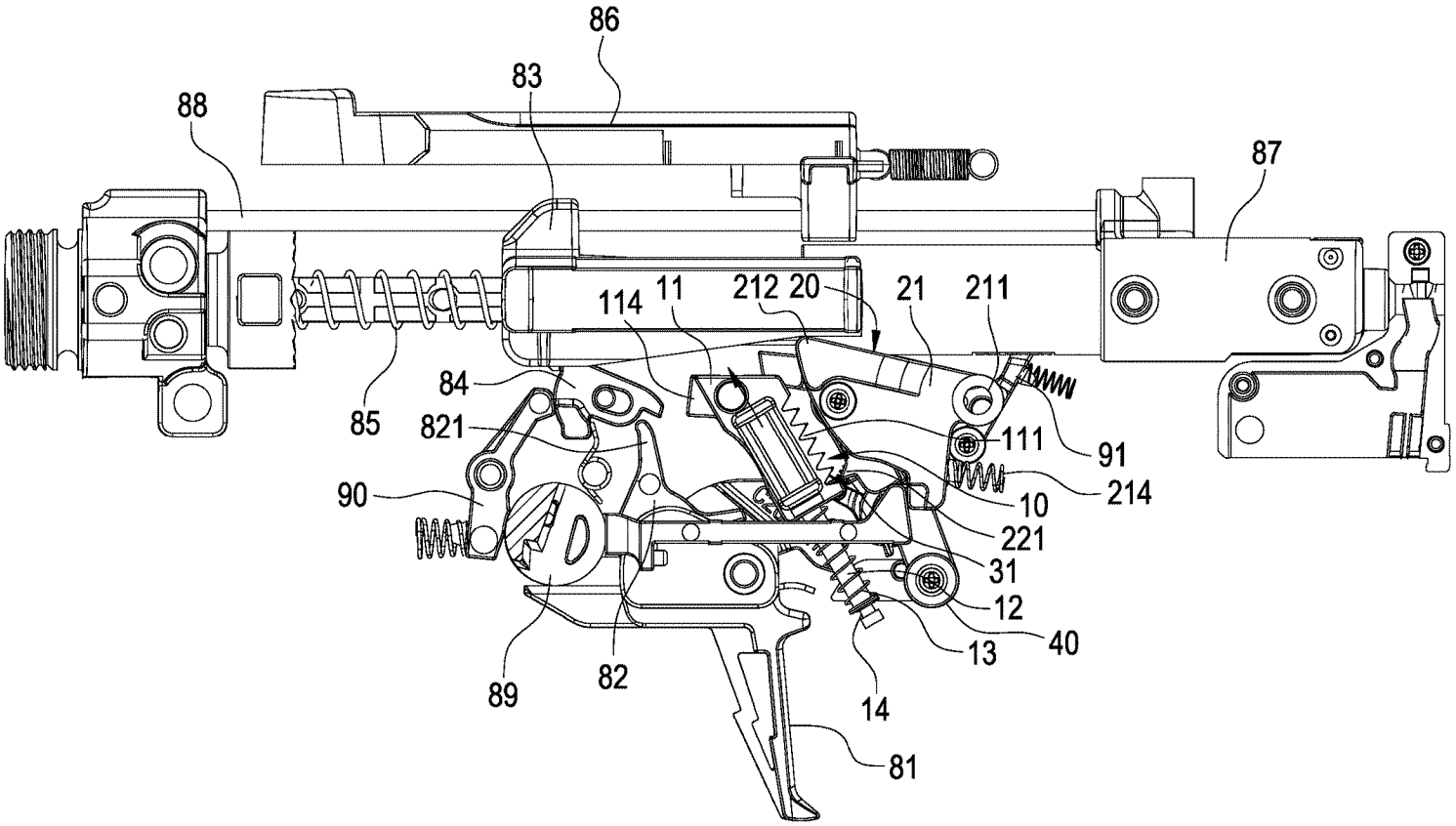
FIG. 12A is a seventh schematic view of a using status of this disclosure.
Figure 12B:
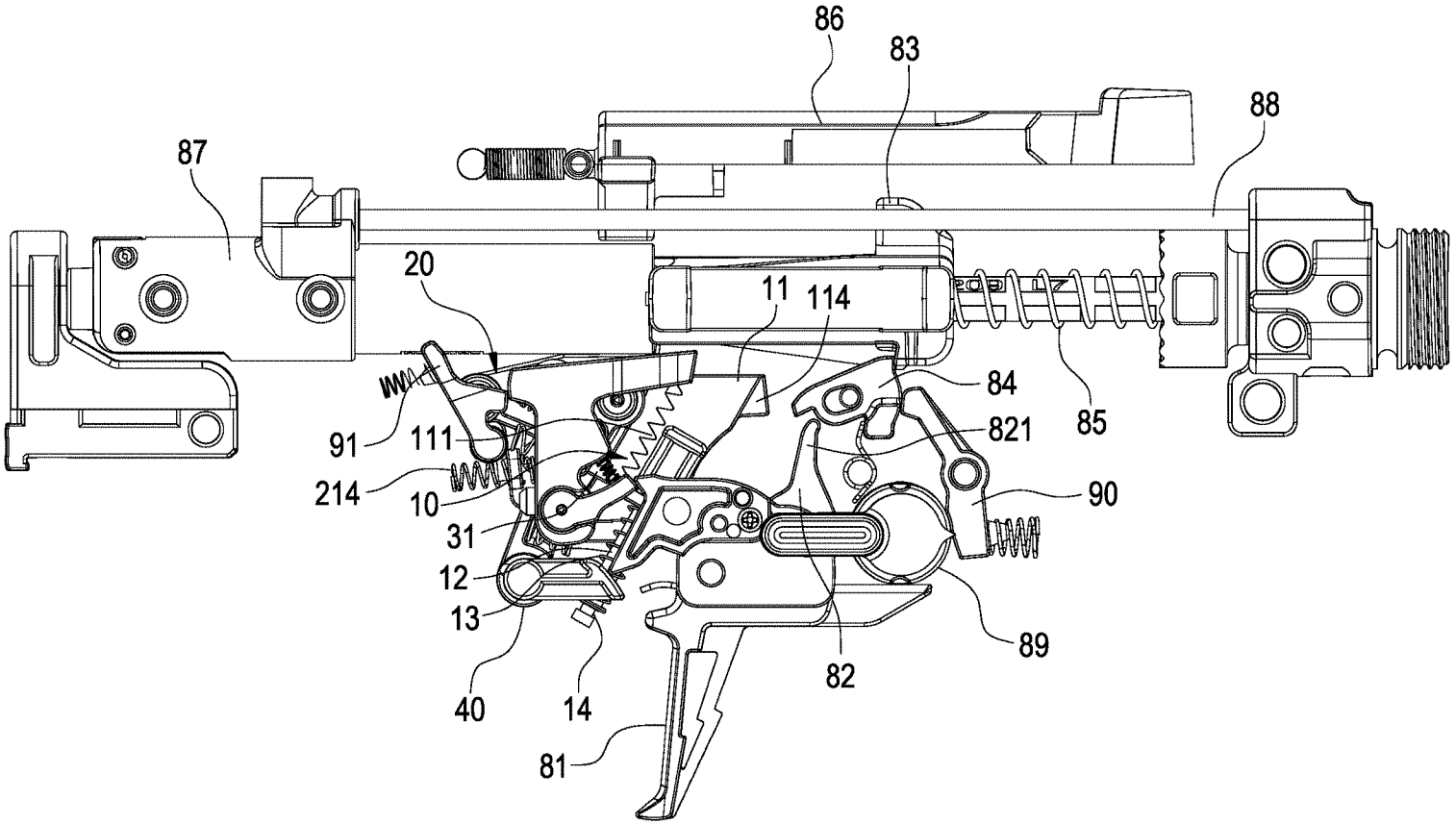
FIG. 12B is a back view of FIG. 12A.

In FIGS. 12A and 12B, when the hammer latch 84 is released from the latch with the first arm 821 of the trigger link rod 82, the air chamber component 87 uses its air pressure to push the hammer 83 to move towards the hammer latch 84. Until the hammer 83 is latched by the hammer latch 84, the shooting is stopped. Now, the trigger 81 is released to link the lever 40, so that the pressing part 22 and the stop part 30 are released by each outer tooth 113 and each inner tooth 112, and the elastic resilience of the elastic member 13 drives the sliding part 11 to resume its original position.

In summation of the description above, the burst device of a toy gun of this disclosure achieves the expected purpose and overcomes the drawbacks of the prior art. This disclosure complies with patent application requirements, and thus is duly filed for patent application. While this disclosure invention has been described by means of specific embodiments, numerous modifications and variations could be made thereto by those skilled in the art without departing from the scope and spirit of the invention set forth in the claims.

What is claimed is:

1. A burst device of a toy gun with a mechanical box (800), comprising:

a sliding mechanism (10), including a sliding part (11), a rod (12) passed and coupled to the sliding part (11), and an elastic member (13) sheathed on the rod (12) and elastically abutting the sliding part (11), and the sliding part (11) having a plurality of teeth (111);

a pressing mechanism (20), disposed on a side of the sliding mechanism (10), and including a pressing plate (21) and a pressing part (22) pivotally coupled to the pressing plate (21), and the pressing part (22) having a latch block (221) operably pushed with respect to each of the teeth (111) to slide the sliding part (11) with respect to the rod (12); and a stop part (30), pivotally coupled to the mechanical box (800), configured to be corresponsive to the sliding part (11), and having a stopper (31) for stopping any one of the teeth (111) after the latch block (221) stops pushing the tooth, wherein the pressing part (22) and the stop part (30) are parallelly arranged;

wherein each of the teeth (111) includes an inner tooth (112) and an outer tooth (113) parallel to the inner tooth (112), and the inner tooth (112) and the outer tooth (113) are disposed on a same end of the sliding part (11); and wherein the latch block (221) is configured to be corresponsive to each respective outer tooth (113), and the stopper (31) is configured to be corresponsive to each respective inner tooth (112).

2. The burst device of a toy gun according to claim 1, wherein each of the teeth (111) is linearly arranged.

3. The burst device of a toy gun according to claim 2, wherein each of the teeth (111) has a bump (114) extended outwardly from an upper part of the sliding part (11) opposite to the tooth (111), and the toy gun (8) has a trigger link rod (82), and the trigger link rod (82) has a first arm (821) and a second arm (822), and the sliding part (11) drives the second arm (822) by the bump (114) in a sliding process to produce a rotation of the trigger link rod (82).

4. The burst device of a toy gun according to claim 2, wherein the rod (12) at an end away from the sliding part (11) has an insert slot (14) for embedding and fixing the mechanical box (800), and both ends of the elastic member (13) are elastically clamped between end surfaces of the mechanical box (800) and the sliding part (11).

5. The burst device of a toy gun according to claim 2, wherein the pressing plate (21) has a first column (213), and a first spring (214) sheathed on the first column (213) and elastically clamped between the pressing plate (21) and the mechanical box (800).

6. The burst device of a toy gun according to claim 2, wherein the pressing part (22) on the opposite side of the latch block (221) has a second column (222), and a second spring (223) sheathed on the second column (222) and elastically clamped between the pressing plate (21) and the pressing part (22).

7. The burst device of a toy gun according to claim 2, wherein the stop part (30) on the opposite side of the stopper (31) has a third column (32), and a third spring (33) sheathed on the third column (32) and elastically clamped between the mechanical box (800) and the stop part (30).

8. The burst device of a toy gun according to claim 2, further comprising a lever (40) installed at a position under the sliding mechanism (10) and the pressing mechanism (20).

9. The burst device of a toy gun according to claim 8, wherein the toy gun (8) has a trigger (81), and the lever (40) is V-shaped, and an arm at an open end of the lever (40) is configured to be corresponsive to the pressing part (22) and the stop part (30), and the arm abuts the trigger (81).

* * * * *